US011620947B1

(12) United States Patent
Wu et al.

(10) Patent No.: US 11,620,947 B1
(45) Date of Patent: Apr. 4, 2023

(54) DISPLAY PANEL AND DISPLAY APPARATUS

(71) Applicants: Wuhan Tianma Microelectronics Co., Ltd., Wuhan (CN); Wuhan Tianma Microelectronics Co., Ltd. Shanghai Branch, Shanghai (CN)

(72) Inventors: Yuantao Wu, Wuhan (CN); Yue Li, Wuhan (CN); Shuai Yang, Wuhan (CN); Mengmeng Zhang, Wuhan (CN)

(73) Assignees: WUHAN TIANMA MICROELECTRONICS CO., LTD., Wuhan (CN); WUHAN TIANMA MICROELECTRONICS CO., LTD. SHANGHAI BRANCH, Shanghai (CN)

( * ) Notice: Subject to any disclaimer, the term of this patent is extended or adjusted under 35 U.S.C. 154(b) by 0 days.

(21) Appl. No.: 17/690,036

(22) Filed: Mar. 9, 2022

(30) Foreign Application Priority Data

Dec. 30, 2021 (CN) ..... 202111662164.7

(51) Int. Cl.
*G09G 3/3233* (2016.01)

(52) U.S. Cl.
CPC ..... *G09G 3/3233* (2013.01); *G09G 2320/041* (2013.01); *G09G 2330/021* (2013.01); *G09G 2330/04* (2013.01)

(58) Field of Classification Search
CPC ..... G09G 3/3233; G09G 2320/041; G09G 2330/021; G09G 2330/04
See application file for complete search history.

(56) References Cited

U.S. PATENT DOCUMENTS

2007/0139312 A1* 6/2007 Kwak ..... G09G 3/006 345/76
2014/0204073 A1* 7/2014 Toyotaka ..... G09G 3/3648 345/212
2017/0098407 A1* 4/2017 Jeong ..... G09G 3/3258
2020/0111418 A1* 4/2020 Nam ..... G09G 3/3266

FOREIGN PATENT DOCUMENTS

CN 112233619 A 1/2021
CN 112581908 A 3/2021

* cited by examiner

*Primary Examiner* — Jeff Piziali
(74) *Attorney, Agent, or Firm* — East IP P.C.

(57) ABSTRACT

The embodiments of present application discloses a display panel and a display apparatus. The display panel includes a pixel circuit including a driving transistor and a data writing module; a data signal line connected to the data writing module and used to provide a data signal to the pixel circuit; and a voltage control module connected to the data signal line; wherein a low-frequency data refresh cycle includes a number of data frames including a data writing frame and n holding frames; in the data writing frame, the data signal line writes the data signal into the driving transistor; in the holding frames, the data signal line does not write the data signal; in first m holding frames, the voltage control module controls the data signal line to be maintained at a first voltage value V1, V1<V2, V2 is a preset data voltage value, and n≥m≥1.

14 Claims, 8 Drawing Sheets

DISPLAY PANEL AND DISPLAY APPARATUS

CROSS REFERENCE TO RELATED APPLICATION

This application claims priority to Chinese Patent Application No. 202111662164.7, filed on Dec. 30, 2021, which is hereby incorporated by reference in its entirety.

TECHNICAL FIELD

The present application relates to the field of display technology, and particularly to a display panel and a display apparatus.

BACKGROUND

Nowadays, display panels have been used in various aspects of our daily life, for example, a display panel may be used as a display interface module of a wearable apparatus for viewing information by a user. However, in a low frequency driving mode of the display panel, if the display panel is in an environment with high temperature, influenced by this temperature, a data writing module of a pixel circuit of the display panel may be turned on more easily, which causes that black ring may be prone to be appeared on the display panel.

SUMMARY

The embodiments of the present application provide a display panel and a display apparatus.

An aspect of the present application provides a display panel including a pixel circuit, which includes a driving transistor and a data writing module; a data signal line connected to an input terminal of the data writing module and used to provide a data signal to the pixel circuit; and a voltage control module connected to the data signal line. A single low-frequency data refresh cycle of the pixel circuit includes a number of data frames, and the data frames comprise a data writing frame and n holding frames; wherein, in the data writing frame, the data signal line writes the data signal into a gate of the driving transistor through the data writing module, and in the holding frames, the data signal line does not write the data signal into the gate of the driving transistor. In first m holding frames following the data writing frame, the voltage control module controls the data signal line to be maintained at a first voltage value V1, V1<V2, V2 is a preset data voltage value for the holding frames, and Another aspect of the present application provides a display apparatus including the above display panel.

BRIEF DESCRIPTION OF THE DRAWINGS

In order to illustrate technical solutions of embodiments of the present application more clearly, the drawings required for the embodiments of the present application will be briefly described. Obviously, the drawings described below are only some embodiments of the present application. For a person skilled in the art, other drawings can also be obtained from these drawings without any inventive effort.

In the drawings.

Figure 1:
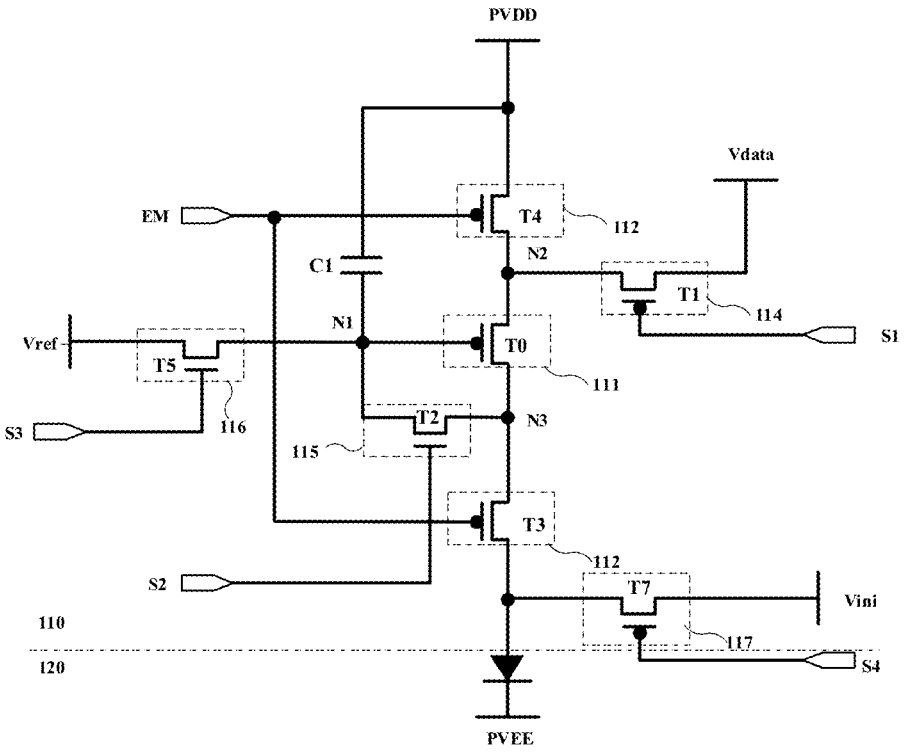
FIG. 1 is an optional schematic circuit structure diagram of a pixel circuit and a light-emitting element in a display panel according to the present application.

110. pixel circuit; 120. light-emitting element; T0. driving transistor; 111. driving module; 112. light-emitting control module; 114. data writing module; 115. compensation module; 116. reset module; 117. initialization module; T1. first transistor (data writing transistor); T2. second transistor; T3. third transistor; T4. fourth transistor; T5. fifth transistor; T6. sixth transistor; T7. seventh transistor; 21. driving circuit; Vdata. data signal; S1. first scan signal; S2. second scan signal; S3. third scan signal; S4. fourth scan signal; Vref. reset signal; EM. light-emitting control signal; *Vini*. initialization signal; 410. pixel unit; 420. voltage control module; Data. data signal line; F0. data writing frame; F1. first holding frame; F2. second holding frame; F3. third holding frame; 421. electro-static discharge circuit; 422. signal control unit; Ma. first switch transistor; Mb. second switch transistor; 423. shorting bar circuit; 424. switch unit; B. first voltage output terminal; G. second voltage output terminal; R. third voltage output terminal; SW. switch control terminal; VGL. constant voltage low level signal; and VGH. constant voltage high level.

DETAILED DESCRIPTION

In order to make the objects, technical solutions and advantages of the present application being understood more clearly, the present application will be described in further detail below with reference to the drawings and embodiments. It should be understood that the specific embodiments described herein are only used to explain the present application, but not to limit the present application.

It should be noted that the orientations or positional relationships indicated by the terms "upper", "lower", "left", "right" and so on, are based on the orientations or positional relationships shown in the drawings, and are only for the convenience of description, rather than indicating or implying that the apparatus or elements referred to must have the particular orientation, or be constructed and operated in the particular orientation, and thus these terms should not be construed as a limitation of this application. The terms "first" and "second" are only used for the convenience of description, and should not be understood as indicating or implying relative importance or impliedly indicating the number of technical features. "A plurality of" means two or more, unless it is expressly specifically limited otherwise. Further, the terms "horizontal", "vertical", "overhanging" and so on, do not imply that a component is required to be absolutely horizontal or overhang, but rather may be slightly inclined. For example, "horizontal" only means that its direction is more horizontal than "vertical", it does not mean that a structure must be completely horizontal, on the contrary, it may be slightly inclined.

It should also be noted that, unless otherwise expressly specified and limited, the terms "arranged", "installed", "connected" and "coupled" should be understood in a broad sense, for example, these terms may indicate a fixed connection, a detachable connection, or an integral connection; or a mechanical connection or an electrical connection; or a direct connection, an indirect connection via an intermediate medium, or an interconnection between two components. For an ordinary person skilled in the art, the specific meanings of the above terms in this application can be understood according to specific situations.

In order to illustrate the technical solutions of the present application, a detailed description is given below with reference to the specific drawings and embodiments.

Referring to FIG. 1, it shows an optional schematic circuit structure diagram of a pixel circuit 110 and a light-emitting element 120 in a display panel according to an embodiment of the present application. The display panel may include the pixel circuit 110 and the light-emitting element 120.

The light-emitting element 120 may be an LED (Light-Emitting Diode), an OLED (Organic Electroluminescence Display), or other element.

The above mentioned pixel circuit 110 may be used to provide a driving current to the light-emitting element 120 of the display panel, and the pixel circuit 110 may also be connected to a data signal line (not shown). The data signal line may be used to provide a data signal Vdata to the pixel circuit 110.

The above mentioned pixel circuit 110 may include a driving module 111, the driving module 111 may include a driving transistor T0, and a gate of the driving transistor T0 receives the data signal Vdata written by the data signal line. When the pixel circuit 110 provides the driving current to the light-emitting element 120, the driving transistor T0 actually serves as a core component of the pixel circuit 110 for generating the driving current.

The above mentioned driving transistor T0 may be an oxide semiconductor transistor, particularly, an IGZO (Indium Gallium Zinc Oxide) transistor, or may be a silicon transistor, particularly, an LTPS (Low Temperature Poly-Silicon) transistor, or other transistor.

Please continue to refer to FIG. 1, in addition to the driving transistor T0, the pixel circuit 110 may further include a light-emitting control module 112, a data writing module 114, a compensation module 115, a reset module 116 and an initialization module 117.

The light-emitting control module 112 may be used to selectively allow the light-emitting element 120 to enter into a light-emitting stage; and the light-emitting control module 112 may include a third transistor T3 and a fourth transistor T4. The control terminals of the third transistor T3 and the fourth transistor T4 are connected to a light-emitting control signal line (not shown) for receiving a light-emitting control signal EM.

When the light-emitting control signal line outputs a valid pulse (i.e., the light-emitting control signal EM), the third transistor T3 and the fourth transistor T4 are turned on, and the light-emitting element 120 is driven to enter into the light-emitting stage, while the driving current flows into the light-emitting element 120. When the light-emitting control signal line outputs an invalid pulse, the third transistor T3 and the fourth transistor T4 are turned off, and a path, through which the driving current flows into the light-emitting element 120, is cut off.

The data writing module 114 may be used to selectively provide the data signal Vdata to the driving transistor T0; the data writing module 114 may include a first transistor T1 (hereinafter also referred to as a data writing transistor). A drain of the first transistor T1 may be connected to a source of the driving transistor T0, a source of the first transistor T1 may be connected to the data signal line and may receive the data signal Vdata, a control terminal of the first transistor T1 may be connected to a first scan signal line and may be used to receive a first scan signal S1, and the first scan signal S1 may be used to control the turn-on and turn-off of the first transistor T1.

The compensation module 115 may be connected between the gate of the driving transistor T0 and a drain of the driving transistor T0, and the compensation module 115 may be used to compensate a threshold voltage of the driving transistor T0. The compensation module 115 may include a second transistor T2, a control terminal of the second transistor T2 is connected to a second scan signal line and may receive a second scan signal S2, and the second scan signal S2 may be used to control the turn-on or turn-off of the second transistor T2.

The reset module 116 may be connected between a reset signal terminal and the gate of the driving transistor T0, and the reset module 116 may be used to provide a reset signal Vref to the gate of the driving transistor T0. The reset module 116 may include a fifth transistor T5, a source of the fifth transistor T5 may be connected to the reset signal terminal and may be used to receive the reset signal Vref, and a gate of the fifth transistor T5 may be connected to a third scan signal line and may be used to receive a third scan signal S3.

The initialization module 117 may be connected between an initialization signal terminal and the light-emitting element 120, and may be used to selectively provide an initialization signal *Vini* to the light-emitting element 120. A control terminal of the initialization module 117 may be connected to a fourth scan signal line and used to receive a fourth scan signal S4.

Optionally, the initialization module 117 may include a seventh transistor T7, a source of the seventh transistor T7 is connected to the initialization signal terminal, a drain of the seventh transistor T7 is connected to the light-emitting element 120, and a gate of the seventh transistor T7 is connected to a fourth scan signal line. When the initialization module 117 is turned on, the pixel circuit 110 enters into an initialization stage.

It can be understood that, based on the optional circuit structure of the pixel circuit 110 and the light-emitting element 120 of the display panel shown in FIG. 1, in order to enable the pixel circuit 110 to provide the driving current to the light-emitting element 120 in an orderly manner, a driving circuit is needed to be arranged in the display panel. Please refer to FIG. 1 together with and FIG. 2, wherein FIG. 2 is an optional schematic driving circuit structure diagram of an embodiment of the display panel according to the present application.

Figure 2:
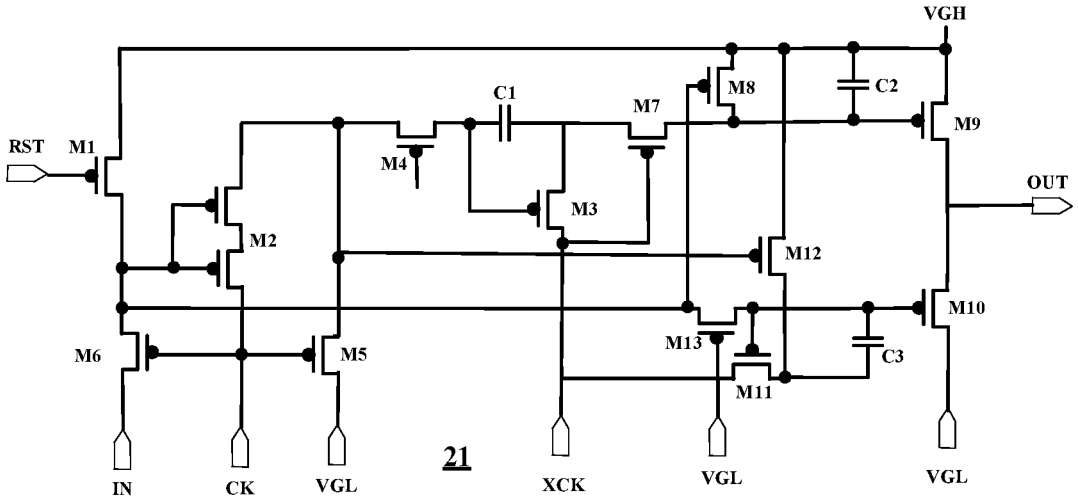
FIG. 2 is an optional schematic circuit structure diagram of driving circuit in a display panel according to the present application.

Referring to FIG. 1 and FIG. 2, it can be understood that the driving circuit 21 may be further arranged in the display panel, and the driving circuit 21 may be used to provide a control signal to the pixel circuit 110. The driving circuit 21 includes a plurality of transistors.

When a display apparatus, in which the display panel including the above mentioned pixel circuit 110, light-emitting element 120 and driving circuit 21 is arranged, is a wearable device, for example, a smart watch, generally, the constant voltage high level signal VGH is set to have voltage value which is relative low, for example, 6V, to reduce power consumption.

In this case, if the display panel is used for displaying in an environment with high temperature, the first transistor T1 (i.e., the data writing transistor) in the data writing module 114 may be turned on more easily, as a threshold voltage of the transistor may be positively biased due to the high temperature of environment. Especially, when the display panel is configured with an edge algorithm, or when a certain area of the display panel is needed to be written black, for example, when the display panel is displaying in AOD (Always On Display) mode, a black ring is prone to be appeared on the display panel.

Figure 3:
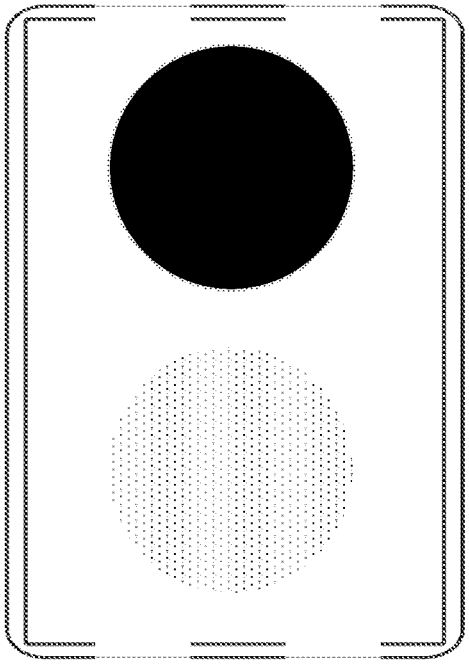
FIG. 3 is a schematic diagram that the display panel displays black ring.

Exemplarily, FIG. 3 shows a schematic diagram of a black ring, which is appeared when a black ball is written on a certain area of the display panel, in an environment with high temperature, and is appeared on an area which is not needed to be written black.

Why the black ring is appeared on the display panel will be described below with reference to FIG. 1, FIG. 2 and FIG. 3. It should be noted that, if the display panel is driven in a dimming mode (Dimming Mode), the data signal line in the pixel circuit 110 in the area which is not needed to be written black has completed the writing of data through the data writing module 114 and is waiting for a valid level of the light-emitting control signal EM, and while the pixel circuit 110 in the area which is needed to be written black is being written into data; the data writing module 114 in the area which is not needed to be written black may be turned on more easily (i.e., the first transistor T1 in the area which is not needed to be written black may be turned on more easily), which causes that the data signal Vdata for the area which is being written black may be coupled to a node N1, in an area which is not needed to be written black, through the data writing module 114, a node N2, the driving transistor T0, and a node N3, and/or this data signal Vdata may be directly coupled to this N1 node through the data writing module 114, and the coupling of this data signal results the voltage of the node N1 in the area which is not needed to be written black being changed into a high level voltage. Then, when the area which is not needed to be written black is driven to emit light next time, a black ring will be appeared in this area, as the conduction state of the driving transistor T0 is changed by this high level voltage of this node N1.

In order to solve the above mentioned technical problem, there are following approaches in the prior art:

a first one of which is to increase the constant voltage high level VGH, so that the first transistor T1 in the data writing module 114 is more difficult to be turned on. However, this approach will cause a higher power consumption of the display panel;

a second one of which is to use a normal mode (Normal Mode) instead of the dimming mode by the display panel; and a third one of which is to stop using the edge algorithm. However, by using this approach, jags may be prone to be appeared at edges of display area of the display panel.

In summary, in order to solve the problem that black ring may be prone to be appeared on the display panel in an environment with high temperature in the prior art, a normal usage of the display panel has to be affected, and thus a new solution for the above technical problem is urgently needed.

Figure 4:
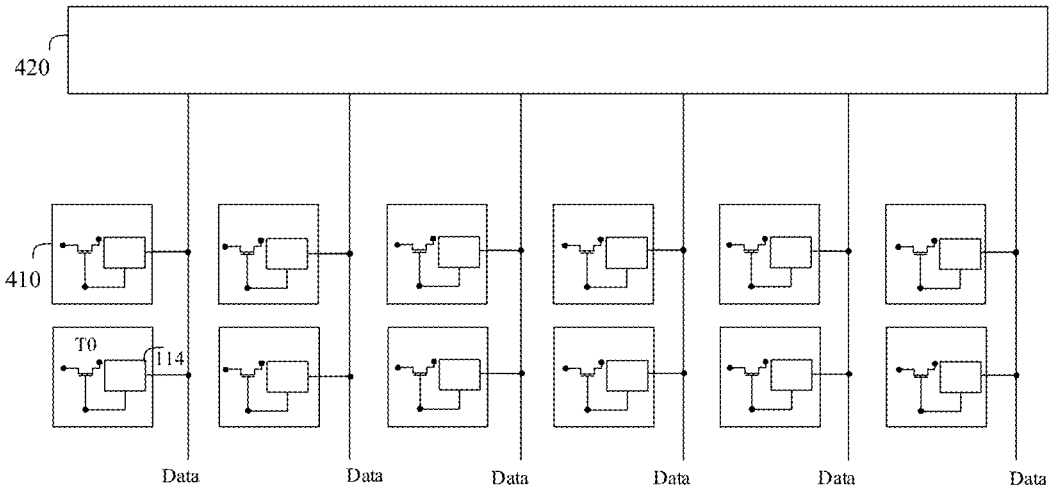
FIG. 4 is a schematic circuit structure diagram of an optional embodiment of a display panel according the present application.

Please refer to FIG. 1 together with FIG. 4, wherein FIG. 4 shows a schematic circuit structure diagram of an optional embodiment of a display panel according to the present application.

In this embodiment, the display panel may include a plurality of data signal lines Data and a plurality of pixel units 410, each pixel unit 410 includes a pixel circuit 110, and each pixel circuit 110 may include a driving transistor T0 and a data writing module 114. The data signal lines Data are connected to the input terminals of the data writing modules 114 in the pixel circuits 110, respectively. The respective data signal lines Data may be used to provide the data signals Vdata to the respective pixel circuits 110.

It should be noted that the structure of the pixel circuit 110 may be specifically arranged according to respective display panels. For example, the structure of the pixel circuit 110 may be arranged with reference to FIG. 1. FIG. 1 further shows the driving transistor T0 and the data writing module 114 of the pixel circuit 110.

When the display panel, in which the circuit structures of FIG. 1 and FIG. 4 are arranged, is driven in a low-frequency driving mode, a single low-frequency data refresh cycle may include one data writing frame and n holding frames, and n may be an integer greater than or equal to 1.

The above mentioned low-frequency driving mode is a mode for performing signal driving at a low data refresh frequency, and the low data refresh frequency may be, for example, 15 Hz, or other frequency.

In the above data writing frame, the data signal lines Data write the data signals Vdata into the respective gates of the driving transistors T0 through the respective data writing modules 114. A main difference between the holding frames and the data writing frame is that, in the hold frames, the data signal lines Data do not write the data signals Vdata to the gates of the driving transistors T0.

On this basis, in order to improve the circumstance that black ring is prone to be appeared on the display panel due to the high temperature of environment, the present application further provides a voltage control module 420, which may be connected to the data signal lines Data, and may be used to program the data signals Vdata, to adjust the voltage values of the data signals Vdata, in the holding frames.

Specifically, in the first m holding frames after the data signal lines Data have written the data signals Vdata into the respective gates of the driving transistors T0 through the respective data writing modules 114, $n \geq m \geq 1$, the voltage control module 420 controls the output voltages of the data signal lines Data to be maintained at a first voltage value V1, which is lower than a preset data voltage value V2 for the holding frames, which may be expressed by mathematical expression as $V1<V2$.

Figure 5:
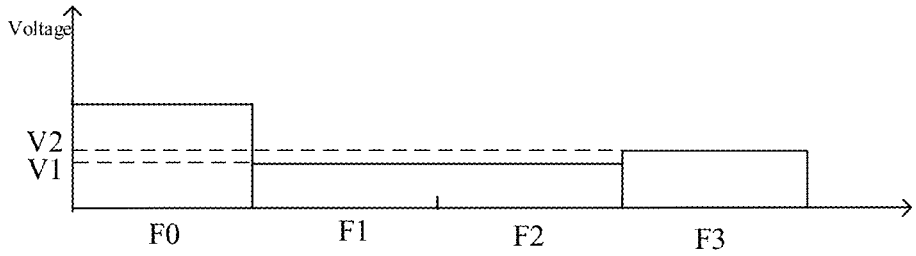
FIG. 5 is a schematic diagram of operating states of data signal in a signal data refresh cycle, when the display panel is operating at a data refresh frequency of 15 Hz, according to the present application.

Exemplarily, please refer to FIG. 1 and FIG. 4 together with FIG. 5, wherein FIG. 5 shows a schematic diagram of operating processes of data signal Vdata in the pixel circuit 110 of the display panel, when the pixel circuit 110 is operating at a data refresh frequency of 15 Hz, according to the present application.

When the data refresh frequency is 15 Hz, a single low-frequency data refresh cycle includes 1 data writing frame F0 and 3 holding frames, the 3 holding frames include a first holding frame F1, a second holding frame F2 and a third holding frame F3. The voltage control module 420 may control the data signal lines Data to be maintained at the first voltage value V1, in the first holding frame F1, or in the first holding frame F1 and the second holding frame F2, or in the first hold frame F1 and the second holding frame F2 and the third hold frame, that is, m∈{1, 2, 3}. Therefore, after the data writing frame F0, a lower voltage level may be provided to the data signal lines Data, and then the black ring circumstance that appears on the display panel due to the influence of the high temperature of the external environment may be improved.

In some embodiments, please continue to refer to FIG. 1 and FIG. 4, when the voltage control module 420 only adjusts the voltage value of the data signal lines Data in the portion of the holding frames, the data signal lines Data may be maintained at the preset data voltage value V2 in the $(m+1)^{th}$ to $n^{th}$ holding frames after the data writing frame.

Still taking FIG. 5 as an example, and in combination with FIG. 1 and FIG. 4, if the voltage control module 420 controls the data signal lines Data to output the first voltage value V1 in the first holding frame F1 and the second holding frame F2, the data signal lines Data may be restored to output the preset data voltage value V2 in the third holding frame F3. In this way, a lower level voltage can be provided to the data signal lines Data in some holding frames following the data writing frame F0, such that the black ring may be improved, and further, it can also be ensured that the edge algorithm may be applied in the rest holding frames corresponding to a higher level.

Alternatively, when the display panel is in the AOD displaying mode, the voltage control module 420 may be used to adjust the voltage values of the data signal lines Data in the holding frames following the data writing frame, such that the problem of more obvious black ring in the area of the display panel which is not needed to be written black, in the AOD mode, may be solved.

In some embodiments, please continue to refer to FIG. 1, FIG. 4 and FIG. 5, on the basis that the first voltage value V1 is smaller than the preset data voltage value V2 for the holding frames, the first voltage value V1 may be a voltage value at which the data writing module 114 is cut off. It can be understood that, in the first m holding frames following the data writing frame, the voltage control module 420 controls the data signal lines Data to be maintained at the first voltage value V1, and thus even if the threshold voltage of the respective transistor is positively biased, the respective data writing module 114 may be maintained in a cut off state by the input of the first voltage value V1. Thus, even if the data signal line(s) Data of the display panel has a voltage for writing black, the respective data writing module 114 in the pixel circuit 110 in the area which is not needed to be written black may be kept as a turn-off state, the voltage of the respective node N1 may be kept unchanged, and the appearance of black ring in this area may be eliminated.

It should be noted that when the first voltage value V1 is a voltage value at which the respective data writing module 114 is cut off, the magnitude of the first voltage value V1 is needed to be set according to the specific structure of the voltage control module 420.

Figure 6:
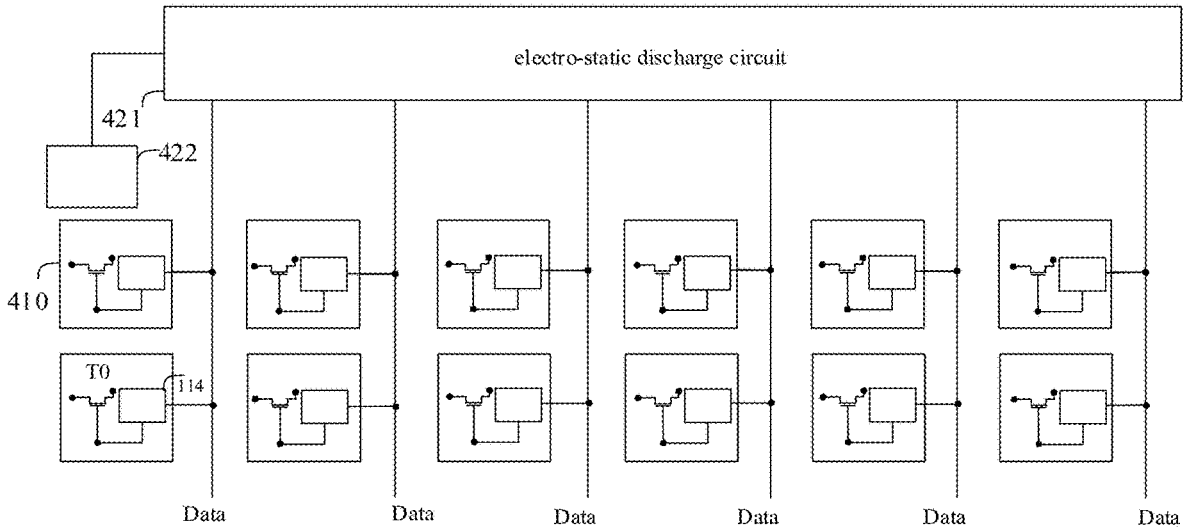
FIG. 6 is a schematic circuit structure diagram of another optional embodiment of a display panel according the present application.

Please refer to FIG. 1 and FIG. 4 together with FIG. 6, wherein FIG. 6 shows a schematic circuit structure diagram of another optional embodiment of the display panel according to the present application. In this embodiment, in addition to the above circuit structure of FIG. 4, a detail structure of the voltage control module 420 is further shown.

The voltage control module 420 may include an electro-static discharge (ESD) circuit and a signal control unit 422. The electro-static discharge circuit 421 may be connected to the data signal lines Data, and the electro-static discharge circuit 421 may be used to enable an electro-static protection in data writing frame.

The signal control unit 422 may be connected to the electro-static discharge circuit 421. The signal control unit 422 may be used to write a second voltage signal V3, in the first m holding frames following the data writing frame, so as to write a voltage into the data signal lines Data by the electro-static discharge circuit 421, to cause the data signal lines to be maintained at the first voltage value V1; wherein, V1<V3.

In this embodiment, after the data writing frame, the second voltage signal is written by the signal control unit 422, and then a voltage is written into the data signal lines by the electro-static discharge circuit 421 by using the connection between the electro-static discharge circuit 421 and the data signal lines Data, such that in the first m holding frames, instead of the preset data voltage value V2 output by the original MUX circuit, the data signal lines Data may be maintained at the first voltage value V1 in this first m holding frames. From this, the structure and voltage writing process used by the voltage control module 420 to maintain the first voltage value V1 in the first m holding frames following the data writing frame are given.

In some optional examples, in the data writing frame, the signal control unit 422 may write a high level signal V4, wherein V1<V3<V4. Thus, the electro-static discharge circuit 421 may also perform an electro-static protection in the data writing frame.

In the $(m+1)^{th}$ to $n^{th}$ holding frames after the data writing frame, the signal control unit 422 is maintained in a high-impedance state, to avoid an interference to other circuits, and to ensure that the AOD mode or edge algorithm may be operated normally in these holding frames corresponding to a higher level.

Figure 7:
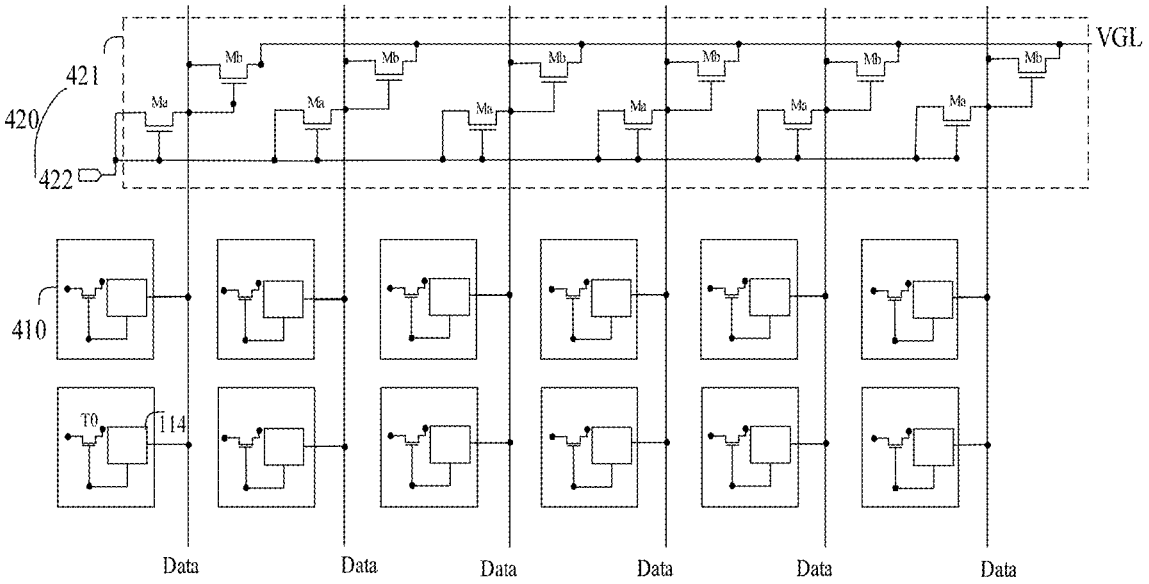
FIG. 7 is a schematic circuit structure diagram of yet another optional embodiment of a display panel according the present application.

Please refer to FIG. 1, FIG. 4 and FIG. 6 together with FIG. 7, wherein FIG. 7 shows a schematic optional structure diagram of the electro-static discharge circuit 421. In this example, for each data signal line Data, the electro-static discharge circuit 421 may correspondingly include a first switch transistor Ma and a second switch transistor Mb. The above mentioned first switch transistor Ma and second switch transistor Mb may be thin film transistors, for example, P-type transistors.

A gate of the first switch transistor Ma is connected to both of a drain of the first switch transistor Ma and the signal control unit 422; a source of the first switch transistor Ma may be connected to a corresponding data signal line Data. A gate of the second switch transistor Mb is connected to both of a drain of the second switch transistor Mb and a corresponding data signal line Data, and a source of the second switch transistor Mb receives a constant voltage low level signal VGL.

In the first m holding frames following the data writing frame, the signal control unit 422 outputs the second voltage signal, to turn on the first switch transistors Ma and turn off the second switch transistors Mb, such that a lower level signal can be written into the respective data signal lines Data, to maintain the data signal lines Data at the first voltage value V1. Thus, the voltage for writing black originally existed on the data signal lines Data may be rewritten, the conduction state of the respective data writing transistor T1 connected to the data signal lines Data may be changed, and voltage level of the corresponding node N1 in the pixel circuit 110 may be maintained stable, such that the circumstance of black ring appeared on the display panel due to the high temperature of the environment may be improved or even eliminated.

Please continue to refer to FIG. 1, FIG. 2, FIG. 4 and FIG. 7, a threshold voltage of the respective first switch transistor Ma in the electro-static discharge circuit 421 may be referred to as Vth. In the holding frames, a gate-source voltage of the respective data writing transistor T1 included in a data writing module 114 is referred to as Vgs, and a voltage received by a gate of the respective data writing transistor T1 is a constant voltage high level signal V5 (that is, the VGH in FIG. 2). Then, the second voltage signal V3, which meets V3<V5−|Vth|−Vgs, may enable that the data signal Vdata with the first voltage value V1 may keep the respective data write transistor T1 being turned off, when the signal control unit 422 outputs the second voltage signal to the electro-static discharge circuit 421.

Through a test, it is known that the gate-source voltage of the respective data writing transistor T1 is about 0.5V, in the holding frames. In the following, for the purpose of exemplary illustration, the gate-source voltage of the respective data writing transistor T1 in the data writing module 114 is assumed to be 0.5V in the holding frames. It is further assumed that the threshold voltage of the respective data writing transistor T1, when the data writing transistor T1 in an off state, is |Vth|, and a source voltage of the data writing transistor T1 has a voltage value of the data signal Vdata output by the data signal line Data, that is, Vs=Vdata.

A gate voltage of the respective data writing transistor T1 has a voltage value of the voltage output by the first scan signal. In the holding frames, the first scan signal outputs a constant voltage high level, and thus the gate voltage Vg of the respective data write transistor T1 is the VGH in the holding frames, that is, Vg=VGH. However, due to the applying of the edge algorithm, the threshold voltage of the respective data writing transistor T1 may be biased in an environment with high temperature, and the respective data writing transistor T1 may be easily to be turned on. When the source-gate voltage of the data writing transistor T1 is less than −0.5 V as tested, the data writing transistor T1 will be turned off.

By using the Vg=VGH and Vs=Vdata, it can be equivalently obtained that Vsg=Vdata−VGH<−0.5, and Vdata<−0.5+VGH.

As shown in FIG. 7, the gate voltage of the respective first switch transistor Ma is the output voltage of the signal control unit 422, and the source voltage of the respective first switch transistor Ma has a value equal to the voltage value of the respective data signal line Data, that is, for the first switch transistor Ma, Vg=V3, and Vs=Vdata.

The respective first switch transistor Ma is needed to be turned on, such that the signal control unit 422 may write a lower level into the respective data signal lines Data then. For this reason, the voltage difference between the source and the gate of the respective first switch transistor Ma needs to be greater than or equal to the threshold voltage |Vth| of the first switch transistor Ma. By using the Vg=V3 and Vs=Vdata, it can be obtained that Vdata-V3≥|Vth|, and V3≤Vdata−|Vth|. Based on the above analysis, it can be known that Vdata<−0.5+VGH, and V3≤VGH−0.5−|Vth|.

Figure 8:
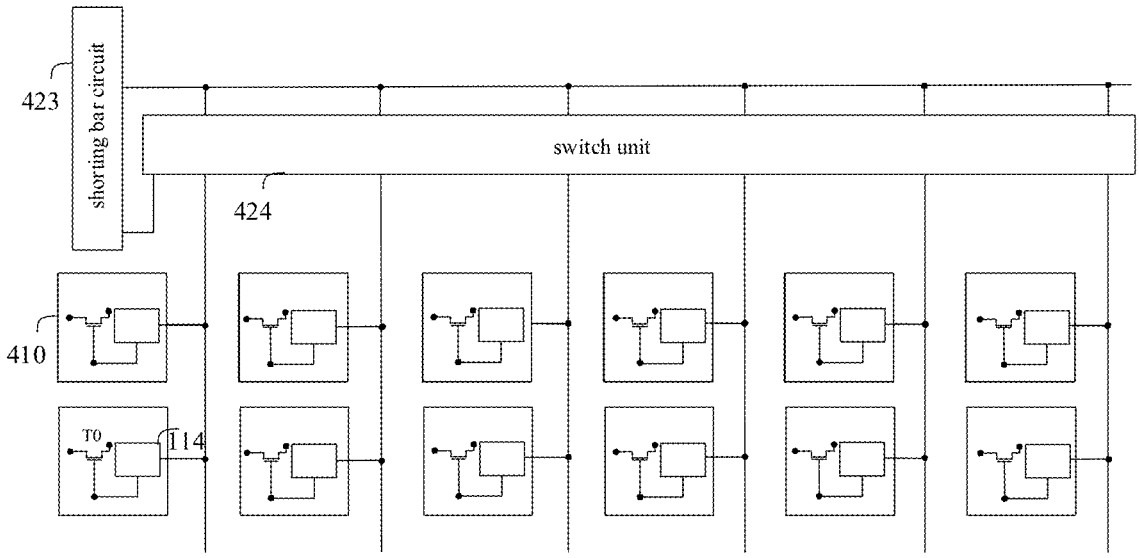
FIG. 8 is a schematic circuit structure diagram of yet another optional embodiment of a display panel according the present application.

In some embodiments, please refer to FIG. 1, FIG. 2, FIG. 4, and FIG. 8, wherein FIG. 8 shows a schematic optional circuit structure diagram of the display panel according to the present application. In this embodiment, the above mentioned voltage control module 420 may include a shorting bar circuit 423 and a switch unit 424.

The switch unit 424 is arranged on the data signal lines Data. The switch unit 424 may be consisted of a thin film transistor. When a gate of the thin film transistor receives a valid level, the switch unit 424 is turned on. A switch control terminal SW of the shorting bar circuit 423 is connected to a control terminal of the switch unit 424, and a voltage output terminal of the shorting bar circuit 423 is connected to the data signal lines Data.

The input terminals of the switch unit 424 are connected to the voltage output terminal of the shorting bar circuit 423 via the respective data signal lines Data, and the output terminals of the switch unit 424 are connected to the input terminals of the respective data writing modules 114 via the respective data signal lines Data.

In the first m holding frames following the data writing frame, the switch unit 424 is turned on, and the voltage output terminal of the shorting bar circuit 423 writes the first voltage value V1 into the data signal lines Data. Therefore, after the data writing frame, the respective data signal Vdata can be written as a lower level signal, which may improve the conduction state of the respective data writing transistor T1, reduce a degree of potential increasing at respective the N1 node, and improve the black ring appeared on display panel due to the high temperature of environment.

Based on the above structures of the shorting bar circuit 423 and the switching unit 424, if the respective data write transistor T1 is needed to be maintained to be completely off, the first voltage value V1 should meet that V1≤V5−Vgs, wherein V5 is the constant voltage high level signal received by the gate of the data writing transistor T1 in the holding frames in the data refresh cycle, and Vgs is the gate-source voltage of the data writing transistor T1.

The process of setting the magnitude of the first voltage value V1 will be descripted in detail in the following. If the respective data writing transistor T1 is needed to be turned off, the switch unit 424 is turned on, and the respective voltage output terminal of the shorting bar circuit 423 finally writes a lower level into the respective data signal line Data. Thus, the magnitude of the source voltage of the respective data writing transistor T1, which equals to a magnitude of a data voltage of the corresponding data line, should be less than or equal to the difference between the constant voltage high level signal and the gate-source voltage of the data writing transistor T1, that is, Vdata=V1≤V5−Vgs.

Therefore, by setting the magnitude of the first voltage value V1 as V1≤V5−Vgs in the first m holding frames following the data writing frame, the respective data signal line Data may be maintained at the first voltage value V1 at these frames, and it may be enabled that the respective data writing transistor T1 is turned off normally. Thus, it may be enabled that the potential of the respective node N1 of the pixel circuit 110 in an area which is not needed to be written black is stable, and the problem of black ring appeared on the display panel due to the influence of the high temperature of environment in the prior art may be avoided, and the normal display and usage of the display panel may be ensured.

On the basis that the voltage control module 420 includes the shorting bar circuit 423 and the switch unit 424, if in a single data refresh cycle, the voltage control module 420 only controls the respective data signal line Data to be maintained at the first voltage value V1 in the portion of the holding frames, the switch control terminal SW of the shorting bar circuit 423 may output an invalid level and the switch unit 424 may be turned off in the rest $(m+1)^{th}$ to $n^{th}$ holding frames after the data writing frame. Taking the switch unit 424 as a P-type transistor as an example, the switch control terminal SW of the shorting bar circuit 423 is at a high level in these frames. The respective data signal line Data can be maintained at the preset data voltage value V2 preset for these holding frames, so as to avoid the normal driving and display of the display panel being affected.

In some embodiments, in the data writing frame, the switch control terminal SW of the shorting bar circuit 423 may also write an invalid level. Taking the switch unit 424 as a P-type transistor as an example again, in this frame, the invalid level for the switch control terminal SW of the shorting bar circuit 423 is a high level, and the switch unit 424 is turned off, and thus it may be enabled that the respective data signal line Data may normally write the data signal Vdata into the gate of the respective driving transistor T0 in the data writing frame.

It should be noted that, when the switch unit 424 is turned off, the respective voltage output terminal of the shorting bar circuit 423 may be maintained in a high-impedance state, or may be set in a floating state, or may have any other voltage signal.

It should be further noted that, in the n holding frames of a single data refresh cycle, the data signal lines Data do not write data into the gates of the driving transistors T0, and at this time, the corresponding clock signal may maintain a constant voltage high level without inverting changes, or may directly suspend its output, thereby reducing power consumption.

Figure 9:
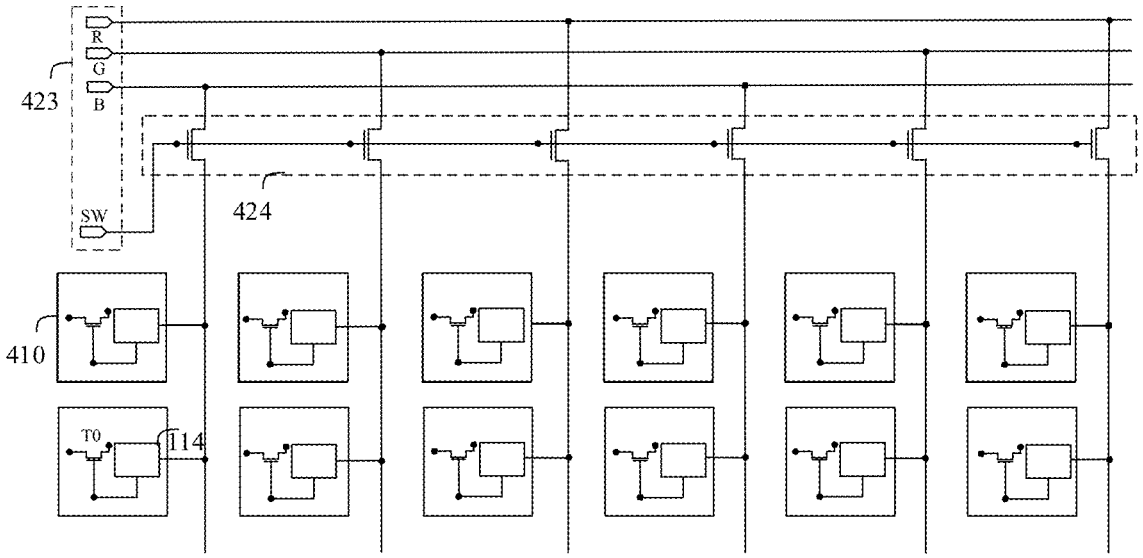
FIG. 9 is a schematic circuit structure diagram of yet another optional embodiment of a display panel according the present application.

Please refer to FIG. 1, FIG. 4 and FIG. 8 together with FIG. 9, wherein FIG. 9 shows an optional structure of the shorting bar circuit 423 in the display panel according to an embodiment of the present application. The voltage output terminal of the shorting bar circuit 423 includes a first voltage output terminal B, a second voltage output terminal G and a third voltage output terminal R. The first voltage output terminal B, the second voltage output terminal G and the third voltage output terminal R are controlled by a programming signal, which may be used combined with a voltage level signal output by the switch control terminal SW of the shorting bar circuit 423, to write voltage signal into the data signal lines Data.

On the basis that three voltage output terminals are arranged, each voltage output terminal may be connected to a corresponding data signal line Data, so as to enable separate data voltage control with respect to respective regions of the display panel.

Exemplarily, please continue to refer to FIG. 9, among the plurality of data signal lines Data, the respective $(3X+1)^{th}$ data signal line Data is connected to the first voltage output terminal B, the respective $(3X+2)^{th}$ data signal line Data is connected to the second voltage output terminal G, and the respective $(3X+3)^{th}$ data signal line Data is connected to the third voltage output terminal R, wherein X is a natural number.

Figure 10:
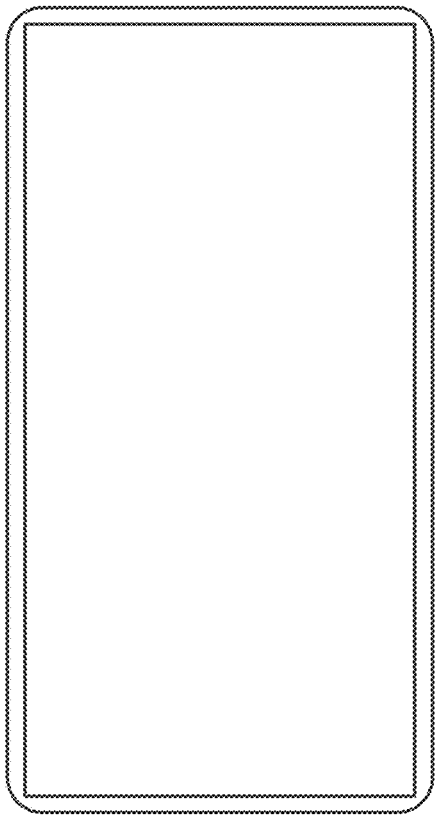
FIG. 10 is a schematic diagram of an embodiment of a display apparatus according the present application.

The display panel according to the embodiment of the present application is described in detail above with reference to FIGS. 1 to 9. On this basis, the embodiment of the present application further provides a display apparatus. Referring to FIG. 10, FIG. 10 is an optional schematic diagram of the display apparatus. In addition, the display apparatus may be at least one of a wearable apparatus, a camera, a mobile phone, a tablet computer, a display screen, a TV and a vehicle-mounted display terminal. The display apparatus includes the display panel according to one of the above mentioned embodiments, and thus the display apparatus has all of the beneficial effects of the above-mentioned display panel.

In addition, the term "and/or" herein only indicates an association relationship for describing associated objects, it indicates that there may be three relationships, for example, A and/or B may indicate three cases including that A exists alone, A and B exist at the same time, and B exists alone. In addition, the character "I" herein generally indicates that the related objects have an "or" relationship.

It should be understood that, in the embodiment of the present application, "B corresponding to A" means that B is associated with A, and B may be determined according to A. However, it should be further understood that determining B according to A does not mean that B is only determined according to A, and B may also be determined according to A and/or other information.

The above description are only specific embodiments of the present application, but the protection scope of the present application is not limited thereto. Any person skilled in the art can easily conceive of various equivalent modifications or substitutions within the technical scope disclosed by the present application. These modifications or substitutions should be within the protection scope of the present application. Therefore, the protection scope of the present application should be subject to the protection scope of the claims.

What is claimed is:

1. A display panel, comprising:

a pixel circuit, comprising a driving transistor and a data writing module;

a data signal line connected to an input terminal of the data writing module and used to provide a data signal to the pixel circuit; and a voltage control module connected to the data signal line;

wherein a low-frequency data refresh cycle of the pixel circuit comprises a number of data frames, and the data frames comprise a data writing frame and n holding frames, and the low-frequency data refresh cycle is a data refresh cycle with a data refresh frequency lower than a data refresh frequency of the pixel circuit under a normal mode of the display panel;

wherein in the data writing frame, the data signal line writes the data signal into a gate of the driving transistor through the data writing module, and in the holding frames, the data signal line does not write the data signal into the gate of the driving transistor;

wherein, in first m holding frames following the data writing frame, the voltage control module controls the data signal line to be maintained at a first voltage value V1, $V1<V2$, V2 is a data voltage value for the holding frames, and $n \geq m \geq 1$, and wherein in $(m+1)^{th}$ to $n^{th}$ holding frames after the data writing frame, the data signal line is maintained at the data voltage value V2.

2. The display panel according to claim 1, wherein the first voltage value V1 is a voltage value at which the data writing module is cut off.

3. The display panel according to claim 1, wherein the display panel is in an AOD (Always On Display) display mode.

4. The display panel according to claim 1, wherein the voltage control module comprises:

an electro-static discharge circuit connected to the data signal line and used to enable an electro-static protection in the data writing frame; and a signal control unit connected to the electro-static discharge circuit and used to write a second voltage signal V3 in the first m holding frames following the data writing frame, so as to write a voltage into the data signal line by the electro-static discharge circuit, to cause the data signal line to be maintained at the first voltage value V1;

wherein, V1<V3.

5. The display panel according to claim 4, wherein in the data writing frame, the signal control unit writes a first level signal V4;

wherein, V1<V3<V4.

6. The display panel according to claim 4, wherein the electro-static discharge circuit comprises:

a first switch transistor, wherein a gate of the first switch transistor is connected to both of a drain of the first switch transistor and the signal control unit, and a source of the first switch transistor is connected to the data signal line; and a second switch transistor, wherein a gate of the second switch transistor is connected to both of a drain of the second switch transistor and the data signal line, and a source of the second switch transistor receives a constant voltage second level signal.

7. The display panel according to claim 6, wherein a threshold voltage of the first switch transistor is Vth; and the data writing module comprises a data writing transistor, and in the holding frames, a gate-source voltage of the data writing transistor is Vgs, and a voltage received by a gate of the data writing transistor is a constant voltage third level signal V5;

wherein, V3<V5−|Vth|−Vgs.

8. The display panel according to claim 4, wherein the signal control unit is maintained in a cut off state, in $(m+1)^{th}$ to $n^{th}$ holding frames after the data writing frame.

9. The display panel according to claim 1, wherein the voltage control module comprises a shorting bar circuit and a switch unit;

the switch unit is arranged on the data signal line;

a switch control terminal of the shorting bar circuit is connected to a control terminal of the switch unit, and a voltage output terminal of the shorting bar circuit is connected to the data signal line; and in the first m holding frames following the data writing frame, the switch unit is turned on, and the voltage output terminal of the shorting bar circuit writes the first voltage value V1 into the data signal line.

10. The display panel according to claim 9, wherein the data writing module comprises a data writing transistor, and in the holding frames, a gate-source voltage of the data writing transistor is Vgs, and a voltage received by a gate of the data writing transistor is a constant voltage third level signal V5; wherein V1≤V5−Vgs.

11. The display panel according to claim 9, wherein in $(m+1)^{th}$ to $n^{th}$ holding frames after the data writing frame, the switch control terminal of the shorting bar circuit writes turn off level, and the switch unit is turned off.

12. The display panel according to claim 9, wherein in the data writing frame, the switch control terminal of the shorting bar circuit writes turn off level, and the switch unit is turned off.

13. The display panel according to claim 9, wherein the voltage output terminal of the shorting bar circuit comprises a first voltage output terminal, a second voltage output terminal and a third voltage output terminal; and the data signal line comprises a plurality of data signal lines, and among the plurality of data signal lines, a respective $(3X+1)^{th}$ data signal line is connected to the first voltage output terminal, a respective $(3X+2)^{th}$ data signal line is connected to the second voltage output terminal, and a respective $(3X+3)^{th}$ data signal line is connected to the third voltage output terminal, wherein X is a natural number.

14. A display apparatus comprising a display panel, wherein the display panel comprises:

a pixel circuit, comprising a driving transistor and a data writing module;

a data signal line connected to an input terminal of the data writing module and used to provide a data signal to the pixel circuit; and a voltage control module connected to the data signal line;

wherein a low-frequency data refresh cycle of the pixel circuit comprises a number of data frames, and the data frames comprise a data writing frame and n holding frames, and the low-frequency data refresh cycle is a data refresh cycle with a data refresh frequency lower than a data refresh frequency of the pixel circuit under a normal mode of the display panel;

wherein in the data writing frame, the data signal line writes the data signal into a gate of the driving transistor through the data writing module, and in the holding frames, the data signal line does not write the data signal into the gate of the driving transistor;

wherein, in first m holding frames following the data writing frame, the voltage control module controls the data signal line to be maintained at a first voltage value V1, V1<V2, V2 is a data voltage value for the holding frames, and n≥m≥1, and wherein in $(m+1)^{th}$ to $n^{th}$ holding frames after the data writing frame, the data signal line is maintained at the data voltage value V2.

* * * * *